US006238207B1

(12) United States Patent
Sarkinen

(10) Patent No.: US 6,238,207 B1
(45) Date of Patent: May 29, 2001

(54) PORTABLE GAS BURNER

(75) Inventor: David Sarkinen, Vagnharad (SE)

(73) Assignee: SSD International Ltd. (GB)

( * ) Notice: Subject to any disclaimer, the term of this patent is extended or adjusted under 35 U.S.C. 154(b) by 0 days.

(21) Appl. No.: 09/508,390

(22) PCT Filed: Sep. 22, 1998

(86) PCT No.: PCT/SE98/01690

§ 371 Date: Jun. 2, 2000

§ 102(e) Date: Jun. 2, 2000

(87) PCT Pub. No.: WO99/17058

PCT Pub. Date: Apr. 8, 1999

(30) Foreign Application Priority Data

Sep. 29, 1997 (SE) ..... 9703502

(51) Int. Cl.[7] ..... F23D 14/38; F23D 14/78

(52) U.S. Cl. ..... 431/353; 126/271.2 R; 432/223

(58) Field of Search ..... 431/33, 91, 353; 126/271.2 A, 271.2 R, 110 B, 110 C, 110 D; 432/222, 223

(56) References Cited

U.S. PATENT DOCUMENTS 2,396,968 * 3/1946 Phillips, Jr. ..... 432/223
2,418,097 * 3/1947 Ruff ..... 126/110 C
2,746,529 * 5/1956 Kamm et al. ..... 432/223
2,780,218 * 2/1957 Allen ..... 126/110 B
4,416,613 11/1983 Barisoff .
5,344,314 9/1994 Zagoroff et al. .
5,891,404 * 4/1999 Ibaraki et al. ..... 431/353

FOREIGN PATENT DOCUMENTS

476780 * 5/1930 (DE) ..... 126/110 C

* cited by examiner

*Primary Examiner*—Ira S. Lazarus
*Assistant Examiner*—Sara Clarke
(74) *Attorney, Agent, or Firm*—Fasth Law Offices; Roth Fasth

(57) ABSTRACT

Portable turner for combustion of a gaseous fuel comprising an elongated combustion chamber (1), the front end of which is open and the back end of which is closed with a back (2) and that is connected partly with a fuel gas conduit (4) and partly with a combustion air conduit (5.1), and that is enclosed by a concentric cooling jacket (1.2) for the flow of a cooling medium. The cooling jacket (12) shows an exhaust opening at the open front end of the combustion chamber (1) and is connected with a cooling air conduit (5.2) for the delivery of cooling air, that in its turn is connected with a compressed air source. The compressed air source may consist of a cooling blower (10) that is connected with an air motor (9) via a shaft (10.1) and that is fed with compressed air from a compressed air conduit (5).

6 Claims, 2 Drawing Sheets

PORTABLE GAS BURNER

TECHNICAL FIELD

The present invention relates to a burner for combustion of a gaseous fuel, comprising an elongated combustion chamber, the front end of which is open and the back end of which is closed with a back. The combustion chamber is connected with partly a fuel gas conduit and partly a combustion conduit, in their turn being arranged to pass a valve mechanism for control of the mixture of gas and combustion air.

BACKGROUND TECHNICS

Burners of the kind described in the preamble may be found in stationary combustion plants where the combustion chamber is located inside e.g. a central heater. The combustion gases, generated by combustion in the combustion chamber, are arranged to be absorbed by the surrounding walls of the combustion chamber or by tubes, if any, through which the combustion gases flow which then are diverted via an exhaust pipe and e.g. through a chimney.

In order to use a burner/heater according to the preamble for other purposes than e.g. for heating of water and generation of steam but instead for the heating of surfaces, e.g. the heating of a bitumen mass when laying roofing-board, the burner has to be manageable by hand and arranged in a way that no damage or injury on account of open flames or too high temperature of the nozzles or the like appear to the roof covering or to the person who handles the device. Modern gas burners work with an open flame that is directed towards the roof covering and might easily set fire to it.

So-called heat guns in which air is heated e.g. by an electrically heated incandescent spiral work without open flame but the heating effect in normally occurring embodiments is too low to use e.g. for laying roofing-board in cool weather. In order to get an increased heating effect from an electrically heated hot-air gun an electric current is needed, which normally is not available in buildings e.g. for housings.

DESCRIPTION OF THE INVENTION

The object of the present invention is to achieve a portable gas burner without the disadvantages of hitherto known portable burners/heaters. The gas burner according to the invention comprises an elongated combustion chamber, the front end of which is open and the back end of which is closed with a back that is connected with partly a fuel gas conduit, partly a combustion air conduit and that is enclosed by a concentric cooling jacket showing one or more chambers for the flow of a cooling medium. The cooling jacket shows a preferably annular exhaust opening at the open front end of the combustion chamber and is connected with a cooling air conduit for the delivery of cooling air, the cooling air conduit in its turn being connected with a compressed air source via a compressed air conduit. Gaseous fuel that is combusted inside the combustion chamber escapes through the front end of the combustion chamber and is mixed with cooling air that escapes from the opening in the cooling jacket. The length of the combustion chamber is adjusted to the amount of gaseous fuel to be combusted inside the chamber in that way that the combustion is completely finished inside the combustion chamber before the combustion gases escape and are mixed with the cooling air. As both the combustion air and the cooling air are pressurized from one or more compressed air sources a jet of heated gas is obtained from the combustion device which jet may be directed towards e.g. a roof covering to be heated.

The cooling jacket may show two or more concentric chambers that are connected in series, the cooling air conduit being preferably the connection to the outer of these chambers. That results in a gradually increased heating of the cooling air before it escapes from the cooling jacket and is mixed with the combustion gas. The cooling jacket increases the heat exchange from the combustion at the same time as it reduces the surface temperature of the burner, something that may permit the burner to be handled without any risk of burn injuries or may permit an additional exterior heat insulation of the cooling jacket consisting of a material that not has to withstand the high temperature inside the combustion chamber.

In order to reduce the consumption of compressed air the burner in an alternative embodiment may be provided with an air motor driven by the compressed air and connected with and arranged to drive a cooling blower by means of which cooling air may be taken from the ambient air and fed into the cooling jacket of the combustion chamber. The exhaust air from the air motor then may be used as combustion air and should be fed into the combustion chamber. The air motor preferably consists of a turbine that is connected with the cooling blower via a shaft. Increasing or decreasing of the amount of compressed air to the air motor acts on both the amount of combustion air and cooling air which results in the desired combustion and cooling with a simultaneous regulation of the amount of fuel gas fed into the combustion chamber.

The compressed air source consists preferably of a compressed-air compressor that may consist of a pressure vessel that has been loaded with air. It lies within the scope of the invention to also admix oxygen to the combustion air if in certain cases a particularly high temperature of the combustion gas is desired.

In addition to the feeding of fuel gas and compressed air the burner also may be provided with feed conduits for a fire extinguishing medium and/or protective gas. If the temperature of the gas that escapes from the combustion chamber at some occasion should get so high that e.g. a roof covering catches fire and starts to burn a valve for a fire extinguishing medium may be opened at the same time as the combustion is interrupted, whereby the fire can be extinguished. If the burner according to the invention is used e.g. for melting of metal as e.g. hard soldering of copper this can be done without oxidation by feeding protective gas annular around the outlet end of the combustion chamber.

The gas burner according to the invention is preferably intended to be portable, e.g. in the shape of a "gun". Yet it lies within the scope of the invention to arrange the burner e.g. on a wheeled stand and also as a stationary assembly where the burner is accessible at work.

DESCRIPTION TO THE DRAWINGS

The invention is described subsequently as an example of an embodiment in connection with the enclosed drawings.

Figure 1:
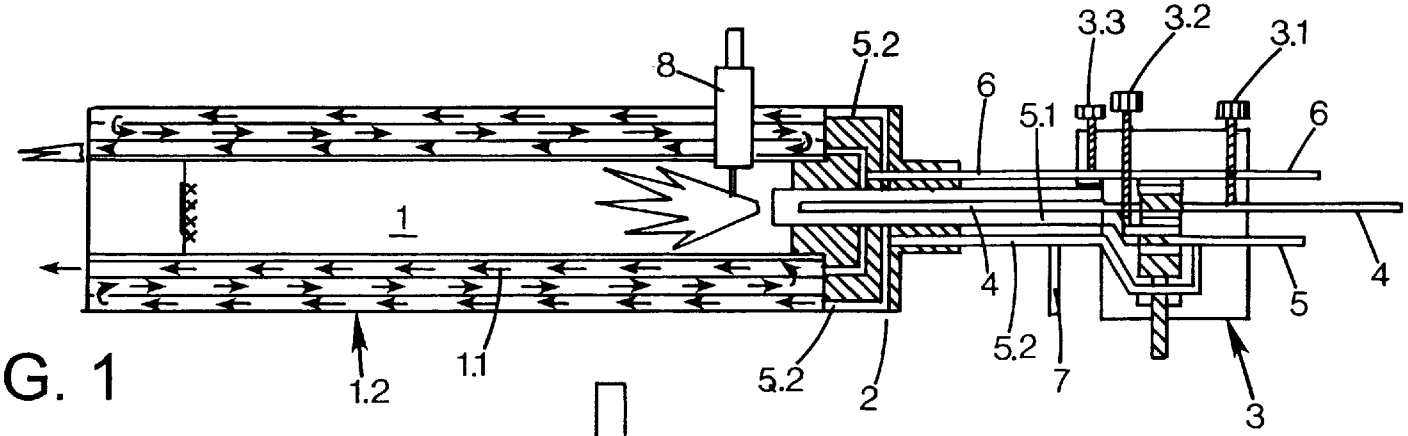
FIG. 1 shows schematically a first embodiment of a burner according to the invention in a longitudinal section.

The burner in the first embodiment as shown in FIG. 1 comprises an elongated combustion chamber 1, formed from a metal pipe 1.1 that in its turn is attached into a tightening back 2. A cooling jacket 1.2 that comprises one or more cooling chambers encloses the combustion chamber 1. A number of conduits are connected to the back 2 via a valve housing 3. These conduits consist of a fuel gas conduit 4 that ends centrally inside the combustion chamber 1, a compressed air conduit 5 that partly is connected with the combustion chamber 1 via a combustion air conduit 5.1 and partly with the cooling jacket 1.2 via a cooling air conduit 5.2, and a conduit 6 for fire extinguishing medium and/or cooling medium such as nitrogen, carbon acid or water. In addition to these conduits a water conduit 7 for the generation of steam arranged in connection with the cooling air conduit 5.2 and connected to it between the back 2 and the valve housing 3. An igniter 8 is arranged to protrude into the combustion chamber 1 quite close to that point into which the fuel gas conduit 4 and the combustion air conduit ends.

The valve housing 3 comprises a two-stage valve that, when opened, first lets out air and afterwards fuel gas to the combustion chamber 1. In addition to that the valve housing 3 shows flow adjusting valves of which a first valve 3.1 acts on the fuel gas conduit 4, a second valve 3.2 acts on the combustion air conduit 5.1 and a third valve 3.3 acts on the conduit 6 for extinguishing medium.

The cooling jacket 1.2 of the embodiment as shown in FIG. 1 consists of three concentric chambers where the cooling air conduit 5.2 is connected to the outermost of these chambers. As shown at the bottom of FIG. 1 cooling air after having passed the outermost chamber escapes into and through the chamber in the middle and then into the innermost chamber to finally escape at the front end of the burner where the cooling air is mixed with the combustion gas from the combustion chamber 1. At the top of FIG. 1 a position is shown where the cooling air is mixed with extinguishing medium that is fed into the inner chamber of the cooling jacket through the extinguishing medium conduit 6.

In an alternative embodiment of the burner according to FIG. 1, oxygen may be added into the combustion air conduit 5.1 to increase the combustion and to increase the temperature of the combustion gases. Actually it is imaginable to add oxygen directly into the compressed air conduit 5 which implies that even the cooling air will contain oxygen.

In a practical embodiment the burner as shown in FIG. 1 may be assembled to a portable unit, e.g. in the shape of a "heat gun" that in its turn is connected to a fuel gas tube via the fuel gas conduit 4, to a compressed air compressor via the compressed air conduit 5 and to a gas tube for extinguishing medium via the extinguishing conduit 6.

Figure 2:
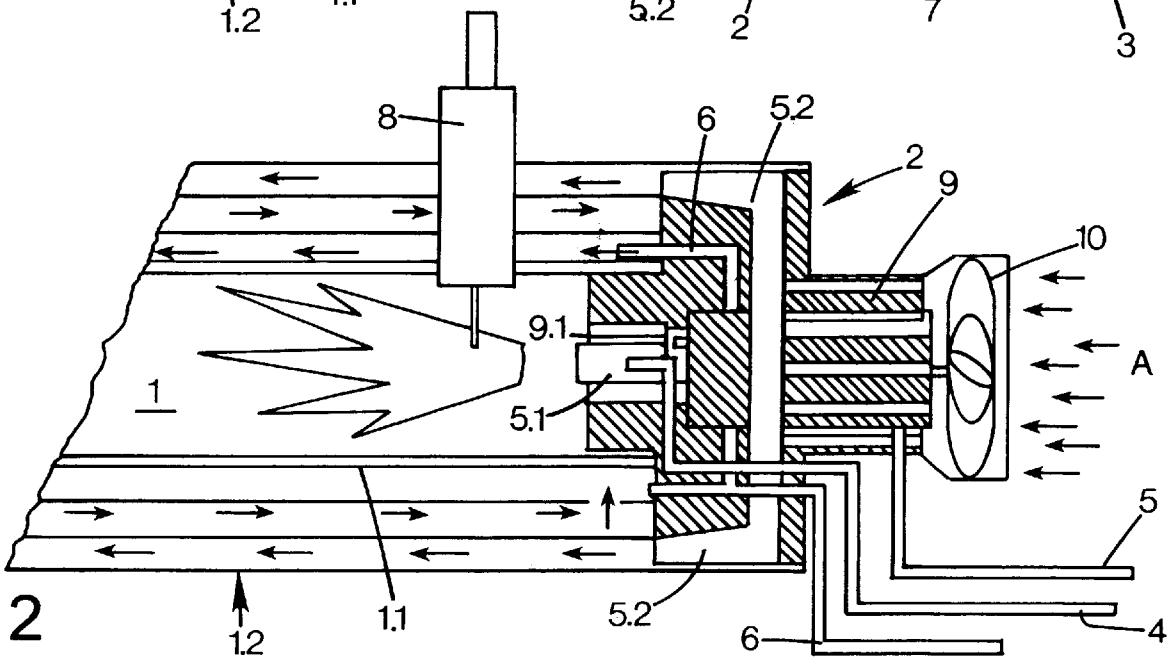
FIGS. 2 and 3 show schematically a second embodiment of a burner according to the invention in a longitudinal section.

The burner in the second embodiment as shown in FIG. 2 like the burner in the first embodiment comprises a combustion chamber 1 in the shape of a pipe 1.1 provided with a back 2 that is connected to a valve housing, not shown in FIG. 2, and enclosed by a cooling jacket 1.2. A fuel gas conduit 4 ends into the combustion chamber 1 while a compressed air conduit 5 is connected to an air motor 9, e.g. in the shape of a turbine which in its turn drives a cooling blower 10 by means of which cooling air is fed from the ambient air according to the arrows A on FIG. 2 via a cooling air conduit 5.2 to the outer chamber in the cooling jacket 1.2. The exhaust air from the air motor 9 leads via a conduit 9.1 to the combustion air conduit 5.1 into which the gaseous fuel conduit 4 ends. An extinguishing medium conduit 6 is connected to the inner chamber in the cooling jacket 1.2 as it is in the first burner embodiment. An igniter 8 is also arranged in the combustion chamber 1. In the second embodiment too, the burner may be assembled to a unity, e.g. in the shape of a heat gun.

Figure 3:
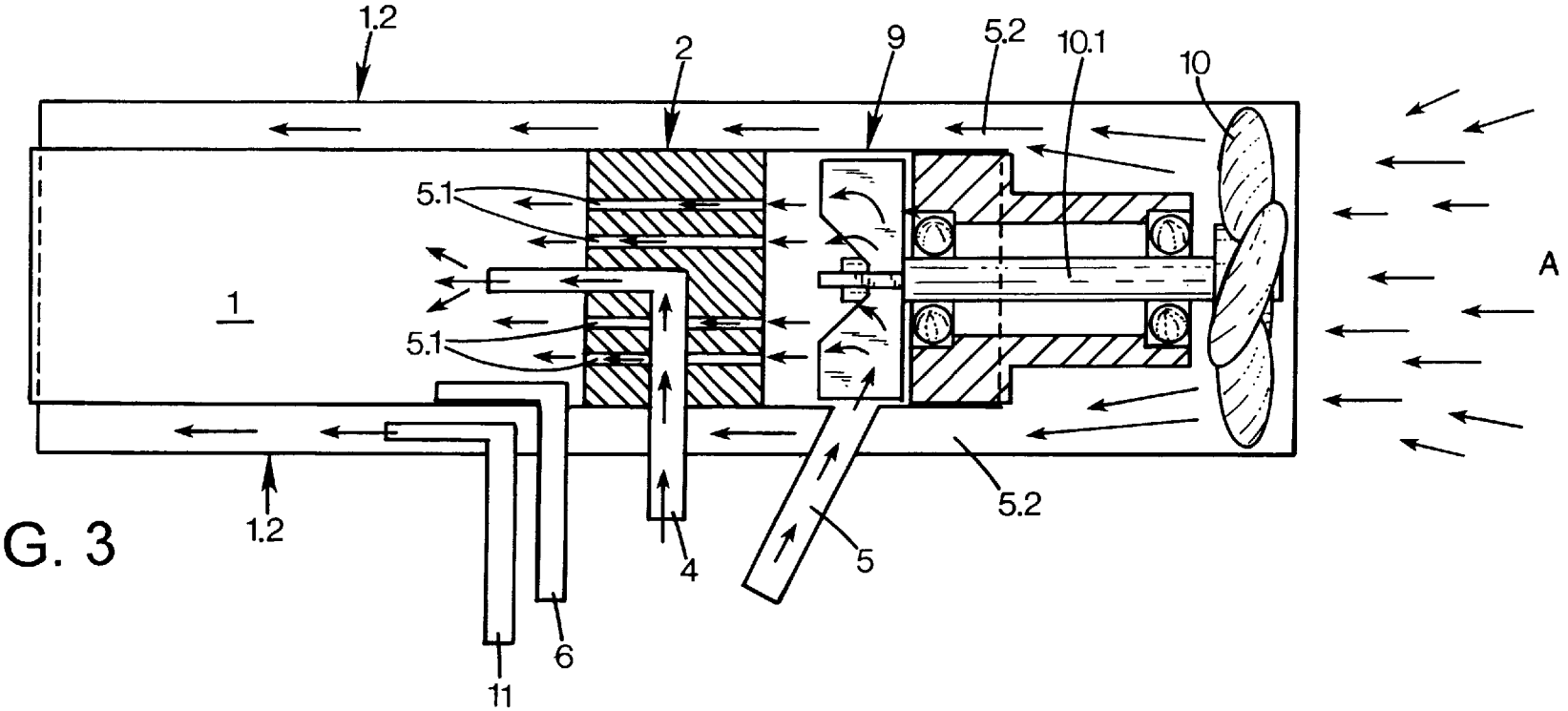

FIG. 3 shows the burner in the second embodiment in an alternative form in which the pipe 1.1 enclosing the combustion chamber 1 is provided with a back 2 but in which the cooling jacket 1.2 merely comprises a ring-shaped chamber that encloses both the combustion chamber 1 and the back 2 and that also encloses a compressed-air-operated turbine 9 to which compressed air is fed from a compressed air conduit 5 and that in its turn drives a cooling blower 10 via a shaft 10.1, journalled in ball bearings. Fuel gas is fed through a fuel gas conduit 4 that ends into the combustion chamber 1 in front of the back 2.

The back 2 is, in turn, connected to ducts 5.1 for feeding combustion air that comprise the exhaust air from the turbine 9. In this embodiment of the burner an extinguishing medium conduit 6 ends into the combustion chamber 1 and a protective gas conduit 11 ends into the hollow space of the cooling jacket 1.2. Like in the above-described embodiments an igniter is envisaged but not shown in FIG. 3. While the present invention has been described in accordance with preferred compositions and embodiments, it is to be understood that certain substitutions and alterations may be made thereto without departing from the spirit and scope of the following claims.

What is claimed is:

1. A portable burner comprising:

a back wall;

the burner having a combustion chamber defined therein, the combustion chamber having an opened front end and a closed back end at the back wall, a fuel gas conduit in fluid communication with the combustion chamber for feeding a fuel gas into the combustion chamber;

a combustion air conduit in fluid communication with the combustion chamber for feeding a combustion air into the combustion chamber;

a concentric cooling jacket attached to the back wall;

a cooling air conduit in fluid communication with the cooling jacket for feeding an over-pressured cooling air into the cooling jacket;

the cooling jacket having an exhaust opening defined therein at the front end of the combustion chamber for mixing the cooling air with a combustion gas produced in the combustion chamber;

the cooling air conduit being in operative engagement with a cooling blower that is being driven by an air motor in operative engagement with the cooling blower; and a compressed air conduit in fluid communication with the air motor for feeding a compressed air to the air motor, the air motor having an exhaust air side in operative engagement with the combustion chamber.

2. The portable burner according to claim 1 wherein the back wall has several bores defined therein and the fuel gas conduit is disposed in a center of a cross section of the combustion chamber, the fuel gas conduit is connected with the back wall.

3. The portable burner according to claim 1 wherein the cooling jacket has an innermost concentric chamber and an outermost concentric chamber defined therein that are connected in series, the cooling air conduit is in fluid communication with the outermost concentric chamber, the cooling air is arranged to flow from the innermost concentric chamber out through the opened end of the combustion chamber.

4. The portable burner according to claim 1 wherein the cooling jacket is connected to a medium conduit for delivering an extinguishing medium to the cooling jacket.

5. The portable burner according to claim 1 wherein the cooling jacket is connected to a medium conduit for delivering a gas to the cooling jacket.

6. The portable burner according to claim 1 wherein the cooling jacket is connected to a gas conduit for delivering a gas to the cooling jacket, a medium conduit is in fluid communication with the combustion chamber for delivering an extinguishing medium into the combustion chamber.

* * * * *